US012534830B2

(12) United States Patent
Stündl et al.

(10) Patent No.: US 12,534,830 B2
(45) Date of Patent: Jan. 27, 2026

(54) APPARATUS AND METHOD FOR PRODUCING A CRIMPED COMPOSITE THREAD

(71) Applicant: Oerlikon Textile GmbH & Co. KG, Remscheid (DE)

(72) Inventors: Mathias Stündl, Rellingen (DE); Eike Holle, Hamburg (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 232 days.

(21) Appl. No.: 18/378,433

(22) Filed: Oct. 10, 2023

(65) Prior Publication Data

US 2024/0133083 A1 Apr. 25, 2024
US 2024/0229306 A9 Jul. 11, 2024

(30) Foreign Application Priority Data

Oct. 25, 2022 (DE) ..... 10 2022 003 999.0

(51) Int. Cl.
*D01D 4/02* (2006.01)
*D01D 5/08* (2006.01)
(Continued)

(52) U.S. Cl.
CPC ..... *D02G 1/167* (2013.01); *D01D 5/082* (2013.01); *D02G 1/127* (2013.01); *D02G 1/161* (2013.01);
(Continued)

(58) Field of Classification Search
CPC ..... D01D 4/02; D01D 5/08; D01D 5/082; D01D 5/088; D01D 5/092; D01D 5/12; D01D 5/16; D01D 5/22; D01D 13/00; D01D 13/02; D02G 1/12; D02G 1/125; D02G 1/127; D02G 1/16; D02G 1/161; D02G 1/167; D02G 1/168; D02G 1/18; D02G 1/20; D02J 1/08; D02J 1/22
(Continued)

(56) References Cited

U.S. PATENT DOCUMENTS 5,184,381 A * 2/1993 Coons, III ..... D02J 1/08 28/271
5,251,363 A * 10/1993 Gerhards ..... D01D 5/082 28/221
(Continued)

FOREIGN PATENT DOCUMENTS

EP 1844186 A1 10/2007
EP 3358052 A1 8/2018
WO 2006081844 A1 8/2006

*Primary Examiner* — Leo B Tentoni
(74) *Attorney, Agent, or Firm* — BainwoodHuang

(57) ABSTRACT

Techniques produce a crimped composite thread, in which multiple individual threads are extruded in each case in the form of a plurality of strand-shaped filaments, cooled, drawn by means of a drawing device and together crimped by means of a crimping device to form the composite thread. Before the multifilament individual threads are crimped, they are entangled separately in each case by means of an entangling unit of an entangling device. A position and/or orientation of at least one of the entangling units relative to the drawing device, the crimping device and/or a further one of the entangling units is changed during the production of the crimped composite thread.

12 Claims, 3 Drawing Sheets

(51) Int. Cl.

| | |
|---|---|
| ***D01D 5/088*** | (2006.01) |
| ***D01D 5/12*** | (2006.01) |
| ***D01D 5/16*** | (2006.01) |
| ***D01D 5/22*** | (2006.01) |
| ***D01D 13/02*** | (2006.01) |
| ***D02G 1/12*** | (2006.01) |
| ***D02G 1/16*** | (2006.01) |
| ***D02G 1/18*** | (2006.01) |
| ***D02G 1/20*** | (2006.01) |
| ***D02J 1/08*** | (2006.01) |
| ***D02J 1/22*** | (2006.01) |
| *D02G 1/00* | (2006.01) |

(52) U.S. Cl.
CPC ..... *D02G 1/168* (2013.01); *D02G 1/004* (2013.01); *D02G 1/125* (2013.01)

(58) Field of Classification Search
USPC ..... 264/40.1, 103, 168; 425/66, 135, 324.1, 425/377, 378.2, 382.2, 464; 28/220, 221, 28/247, 248, 250, 253, 258, 271
See application file for complete search history.

(56) References Cited

U.S. PATENT DOCUMENTS

2013/0140729 A1* 6/2013 Stundl ..... D02J 1/08 264/103
2020/0115824 A1* 4/2020 Stündl ..... D01D 5/22

* cited by examiner

APPARATUS AND METHOD FOR PRODUCING A CRIMPED COMPOSITE THREAD

The present invention relates to an apparatus for producing a crimped composite thread and to a method for producing a crimped composite thread as disclosed herein.

An apparatus of this type for producing the crimped composite thread has a spinning device, a cooling device and a drawing device for producing multiple multifilament individual threads. The apparatus of this type for producing the crimped composite thread further has a crimping device for bringing the individual threads together to form the composite thread, and an entangling device, arranged upstream of the crimping device, for entangling the individual threads separately in each case by means of an entangling unit. During the method for producing the crimped composite thread, multiple individual threads are extruded, in each case in the form of a plurality of strand-like filaments, cooled, drawn by means of the drawing device and together crimped by means of the crimping device to form the composite thread. Prior to crimping, the multifilament individual threads are entangled separately in each case by means of one of the entangling units of the entangling device.

Such an apparatus and such a method are known from EP 3 358 052 B1. The crimped composite thread is preferably processed further to form a carpet. Composite threads produced from three individual threads of different colours are frequently used. In order to produce different colourations of the composite thread and thus of the carpet produced therefrom, the individual threads are here selectively guided through the entangling units arranged upstream of the crimping device or past the entangling units arranged upstream of the crimping device. However, the different colourations of the composite thread which can be produced in this way are still not sufficient to satisfy the customers' high demands in terms of the flexibility of these colourations.

A further apparatus for producing a crimped composite thread from three individual threads of different colours is known from EP 1 844 186 B1, wherein multiple entangling units are here arranged in the thread run of at least one individual thread in order to produce different colourations of the composite thread. The adjustability and range of variability of the colouration of the composite thread can here be improved by entangling each of the different individual threads with different compressed air set-point values of a compressed air supply.

However, the different colourations of the composite thread which can be produced in this way are also not sufficient to satisfy the customers' high demands in terms of the flexibility of the colourations.

The present invention is based on the object of providing an apparatus and a method for producing a crimped composite thread which reduce or eliminate the problems of the prior art. In particular, the composite thread is to be able to be produced with an even greater colour spectrum.

This object is achieved by an apparatus for producing a crimped composite thread as disclosed herein.

Further advantageous embodiments are subject matter as disclosed herein.

More specifically, the object is achieved in that a position and/or orientation of at least one of the entangling units relative to the drawing device, the crimping device and/or a further one of the entangling units can be changed by means of at least one actuator.

In tests, it has been possible to show that specifically the position of the entangling units relative to the drawing device, the crimping device and/or a further one of the entangling units also has a certain influence on the colouration of the composite thread, which differs significantly, for example, from the influence of different compressed air set-point values of the respective compressed air supplies. With the position of the entangling units, in particular the feed and discharge angles of the individual threads into the entangling units and out of the entangling units and the feed angles into the crimping device, which likewise have a corresponding influence on the colouration of the composite thread, are also adjustable. By means of the actuator, a new position and thus also the corresponding feed and discharge angles, which are known beforehand, can quickly be set and thus a corresponding desired colouration of the composite thread can be produced. By using an actuator to adjust at least one of the entangling units, automatic adjustment, even during operation of the apparatus, is possible. Overall, the flexibility in the colouration of the composite thread can be increased further, so that a particularly broad colour spectrum in the composite thread can be achieved. In particular, a colour dominance of one of the colours of the individual threads in a carpet produced by means of the composite thread can be set precisely. The different colours of the individual threads are, for example, blue, yellow and red.

Advantageously, each entangling unit has an entangling nozzle, which entangling nozzles are arranged on a common carrier of the entangling device. The position and/or orientation of the carrier can be changed by means of the at least one actuator.

The adjustment of all the entangling units with the common carrier can easily be implemented mechanically. In some circumstances, a single actuator is sufficient to achieve the desired flexibility in the colouration. Furthermore, non-adjustable carriers which are already known can be used with only slight adaptations, namely with the coupling with the actuator. The actuator is preferably arranged between the carrier and a machine frame of the apparatus for producing a crimped composite thread.

In a preferred embodiment of the invention, each entangling unit has an individual carrier for holding the associated entangling nozzle. The position and/or orientation of each individual carrier can be changed in each case by means of at least one actuator.

By arranging the entangling units on individual carriers, the position of the entangling units relative to one another can in particular be adjusted. On account of the associated actuators, this can be carried out particularly quickly, preferably in an automated manner and in particular during operation of the apparatus. The flexibility in the colouration of the composite thread is thus increased further.

Further preferably, an adjustment range of at least one of the actuators is from 5 mm to 60 mm, preferably from 5 mm to 25 mm.

In this range, a large number of desired colourations/colour patterns can be achieved in the composite thread. Furthermore, it is thus ensured that, in the case of conventional distances between the drawing device arranged upstream of the entangling units and the crimping device arranged downstream of the entangling units, the individual threads are not deflected too greatly as they enter and/or leave the entangling units. Too great a deflection would lead to excessive friction between the entangling unit and the individual thread.

According to a particularly preferred embodiment of the apparatus, the at least one actuator is configured to permit a movement of the carrier and/or individual carrier coupled with the actuator in at least one of six degrees of freedom, in particular a displacement in an X, Y and/or Z direction and/or a rotation about an X, Y and/or Z axis.

In order to make these movements possible, a large number of variants of actuators and combinations of actuators are conceivable. The actuators or combinations of actuators are adapted to the carrier and/or the individual carriers and also, in some circumstances, to intermediate transmission elements and the bearing of the carrier and/or individual carriers on the machine frame, for example. It is conceivable that the individual carriers are used without a common carrier, wherein the actuators are then arranged in each case between one of the individual carriers and the machine frame. It is further conceivable both that the common carrier is present and movable by means of an actuator coupled with the machine frame and further that the individual carriers are mounted on the common carrier and movable by means of in each case an actuator arranged between the carrier and each of the individual carriers.

It can be advantageous if the at least one actuator is connected to a control device for the activation, preferably the automatic activation, of the actuator.

In addition to automatic activation, the control device also makes it possible to store specific, preferred positions of the entangling units, which if required can then be retrieved and set, in particular in an automated manner.

A separately controllable compressed air supply is preferably associated with each of the entangling units.

The entanglement of each individual thread can thus be controlled separately, so that the flexibility of the colouration of the composite thread is further increased.

The object on which the invention is based is also achieved by a method for producing a crimped composite thread as disclosed herein.

More specifically, the object is then achieved in that a position and/or orientation of at least one of the entangling units relative to the drawing device, the crimping device and/or a further one of the entangling units is changed during the production of the crimped composite thread.

By changing the position and/or orientation of at least one of the entangling units during the production of the crimped composite thread, the colouration is also changed during operation. A colour pattern of a carpet produced by means of the composite thread can thus also be adjusted in a particularly versatile manner.

The position and/or orientation of the entangling device, namely of all the entangling units together, relative to the drawing device and/or relative to the crimping device is advantageously changed during the production of the crimped composite thread.

This variant can be implemented with a particularly low outlay in terms of apparatus but also in terms of open-loop and/or closed-loop control.

According to an advantageous embodiment of the method, the position and/or orientation of at least one of the entangling units is changed automatically by means of a control device on the basis of measured properties of the composite thread, in particular the colour thereof, in order to achieve desired properties of the composite thread, in particular the colour thereof.

In this way, a desired colouration of the composite thread can be achieved particularly reliably. To that end, corresponding algorithms for evaluating the properties of the composite thread measured by means of a sensor, preferably an optical sensor, and for subsequently generating control signals for the at least one actuator are carried out in the control device.

It can be advantageous if the position and/or orientation of at least one of the entangling units is changed by means of the control device on the basis of a predefined movement pattern present in the control device.

The movement pattern is preferably implemented such that the at least one entangling unit that is moved performs periodic movements. Such a movement pattern then results in a changing colouration of the composite thread. In a particularly simple form, a distance of this entangling unit from the crimping device could be changed between two end positions, that is to say the entangling unit could be moved to and from between these two end positions. Such a periodic movement has a period which can last several minutes or which in some cases is also below one second. The period means the time required to move the entangling unit from one of the two end positions to the other end position and back again.

Further preferably, the individual threads are entangled with in each case different compressed air set-point values of a compressed air supply.

In this way, colour dominance of one of the colours of the individual threads in a carpet produced from the composite thread can be achieved in a dotted manner. That is to say, regions of the colours of the individual threads that are clearly distinguishable from one another are visible in the carpet.

As already described, the crimped composite threads are further processed in particular to form carpets.

BRIEF DESCRIPTION OF THE FIGURES

In the following text, preferred embodiments will be described in greater detail with reference to the accompanying figures.

DESCRIPTION OF EXAMPLE EMBODIMENTS

Figure 1:
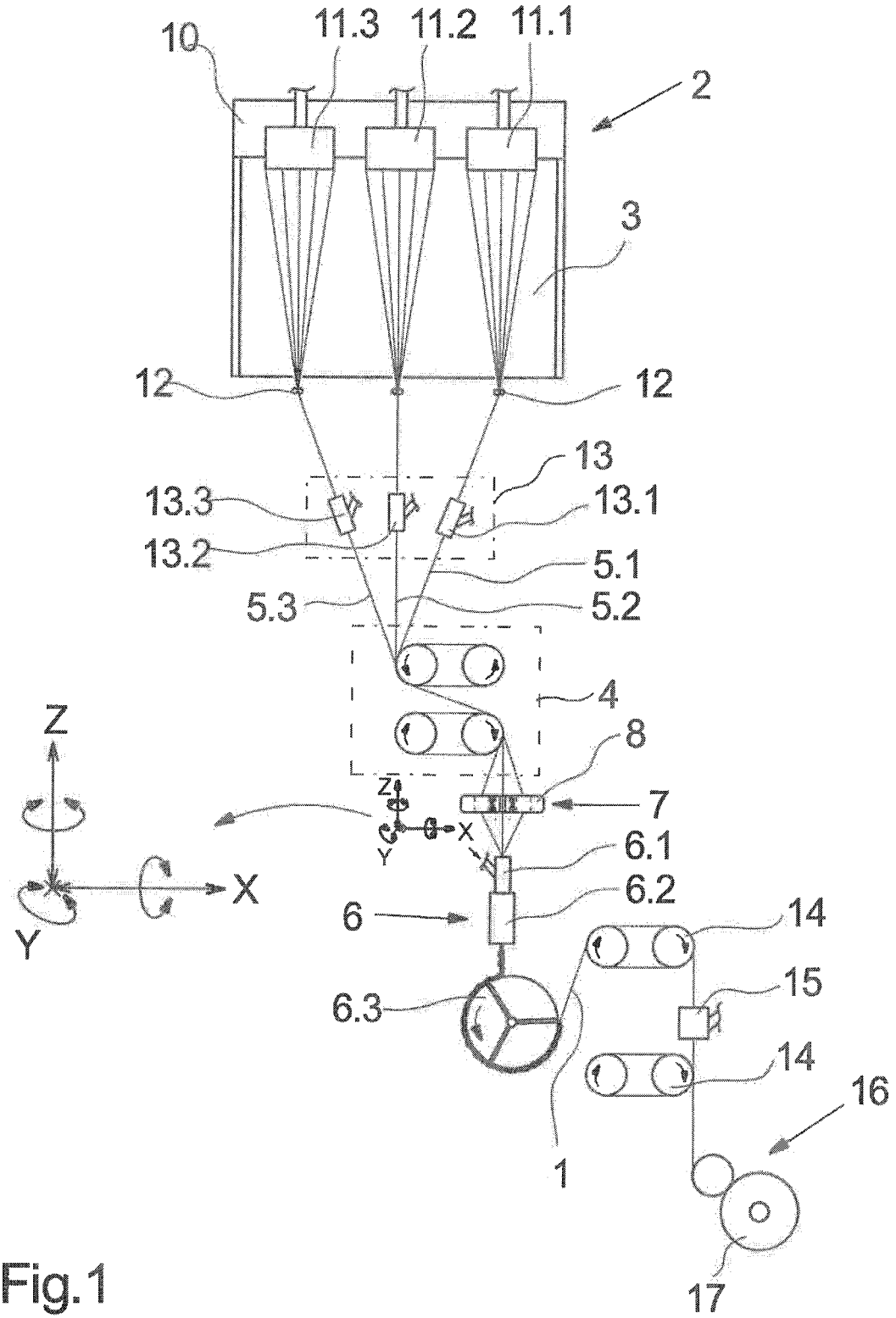
FIG. 1 shows, schematically, a first embodiment of the apparatus for producing a crimped composite thread in a side view.
Figure 2:
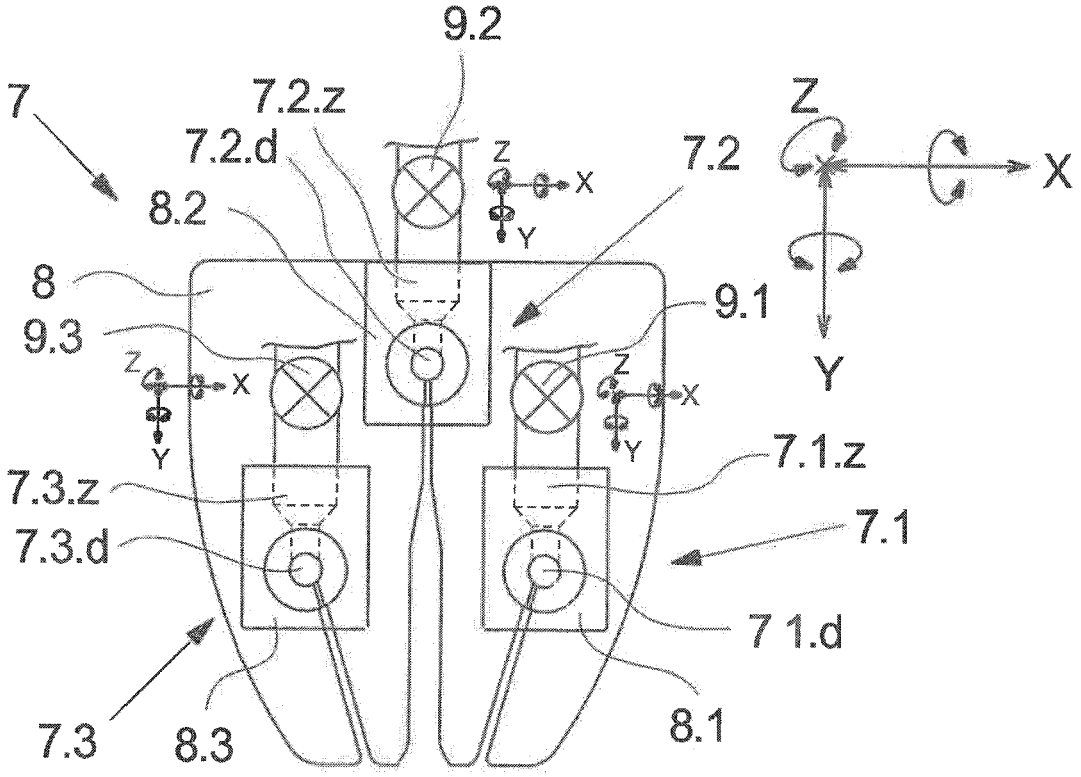
FIG. 2 shows, schematically, an entangling device of a second embodiment of the apparatus for producing a crimped composite thread in a plan view.
Figure 3:
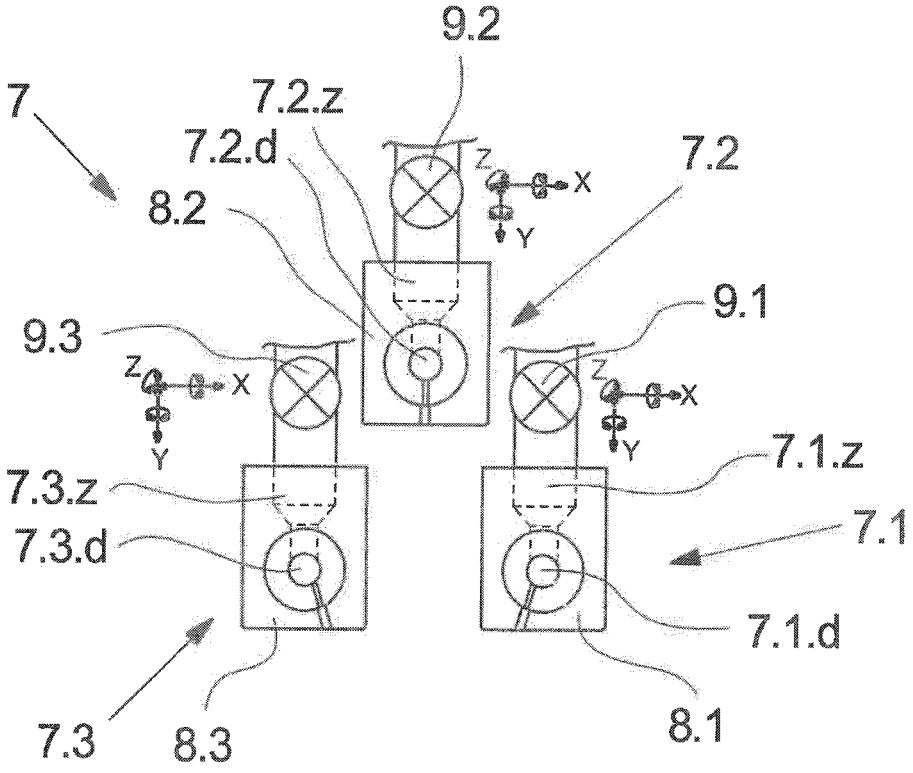
FIG. 3 shows, schematically, an entangling device of a third embodiment of the apparatus for producing a crimped composite thread in a plan view.

The apparatus for producing a crimped composite thread 1 according to FIGS. 1 to 3 has, inter alia, a spinning device 2, a cooling device 3 and a drawing device 4 for producing multiple multifilament individual threads 5.1, 5.2, 5.3. The apparatus for producing the crimped composite thread 1 further has, inter alia, a crimping device 6 for bringing the individual threads 5.1, 5.2, 5.3 together to form the composite thread 1, and an entangling device 7, arranged upstream of the crimping device 6, for separately entangling the individual threads 5.1, 5.2, 5.3 by means of in each case an entangling unit 7.1, 7.2, 7.3.

According to FIG. 1, the crimping device 6 is formed by a stuffer box crimping device, which has a conveying nozzle 6.1, a stuffer box 6.2 and a cooling drum 6.3. The individual threads 5.1, 5.2 and 5.3 are together compressed by a hot conveying medium to form a fibre plug. The fibre plug is then cooled on the periphery of the cooling drum 6.3 and opened to form the composite thread 1.

A position and/or orientation of at least one of the entangling units 7.1, 7.2, 7.3 relative to the drawing device 4, the crimping device 6 and/or a further one of the entangling units 7.1, 7.2, 7.3 can be changed by means of at least one actuator.

The double arrows shown adjacent to the entangling device 7 in FIGS. 1 and 2 and also adjacent to the entangling units 7.1, 7.2, 7.3 in FIGS. 2 and 3 symbolize the possible movements which can be implemented by means of such actuators, wherein the actuators themselves are not shown for reasons of clarity. The double arrows are shown with reference to cartesian coordinate systems with X, Y and Z axes. FIG. 1 shows the double arrows in the associated cartesian coordinate system on the one hand next to the entangling device 7 and additionally in an enlarged representation for the purpose of clarification.

Each entangling unit 7.1, 7.2, 7.3 has an entangling nozzle 7.1.*d*, 7.2.*d*, 7.3.*d*, which entangling nozzles are arranged according to FIGS. 1 and 2 on a common carrier 8 of the entangling device 7. The position and/or orientation of the carrier 8 can be changed by means of the at least one actuator.

The first and second embodiments of the apparatus for producing a crimped composite thread 1 according to FIGS. 1 and 2 have such a common carrier 8. The third embodiment of the apparatus for producing a crimped composite thread 1 is without a common carrier 8. The carrier 8 is mounted preferably on a machine frame (not shown here) by means of a bearing device (not shown here) so as to be movable relative to the surroundings. Such a bearing device could also be formed by means of the actuator. The actuator is preferably also held on such a machine frame. The drawing device 4 and the crimping device 6 are also in particular connected to the machine frame.

According to FIGS. 2 and 3, each entangling unit 7.1, 7.2, 7.3 has an individual carrier 8.1, 8.2, 8.3 for holding the associated entangling nozzle 7.1.*d*, 7.2.*d*, 7.3.*d*. The position and/or orientation of each individual carrier 8.1, 8.2, 8.3 can be changed in each case by means of at least one actuator.

The first embodiment of the apparatus for producing a crimped composite thread 1 from FIG. 1 is without such individual carriers. According to FIG. 2, the individual carriers 8.1, 8.2, 8.3 are arranged on the common carrier 8 and are then each also movable relative to the carrier 8 by means of the associated actuator. Each individual carrier 8.1, 8.2, 8.3 thus has a bearing device (not shown here) by means of which each individual carrier 8.1, 8.2, 8.3 is coupled with the carrier 8, wherein these bearing devices can also be formed by means of the respective actuators. According to FIG. 3, the individual carriers 8.1, 8.2, 8.3 are mounted preferably on a machine frame (not shown here) by means of a respective bearing device (not shown here) so as to be movable relative to the surroundings without an intermediate common carrier. Such bearing devices could also be formed by means of the actuators. The actuators are preferably also held on such a machine frame.

An adjustment range of at least one of the actuators is from 5 mm to 60 mm, preferably from 5 mm to 25 mm.

In particular, the actuator has a central rest position, from which the actuator is movable in two opposite directions in each case by from 10 mm to 30 mm, preferably from 17.5 mm to 22.5 mm.

The at least one actuator is configured to permit a movement of the carrier 8 and/or individual carrier 8.1, 8.2, 8.3 coupled with the actuator in at least one of six degrees of freedom, in particular a displacement in an X, Y and/or Z direction and/or a rotation about an X, Y and/or Z axis.

The displacements in the X, Y and/or Z direction are symbolized in FIGS. 1 to 3 in each case by a straight double arrow, and the rotation about the X, Y and/or Z axis is symbolized in each case by a curved double arrow. For displacement in one of the directions, an electric, pneumatic or hydraulic linear actuator is preferably provided. In order to permit a displacement of the carrier 8 in all three directions, three such linear actuators, for example, in each case arranged at right angles to one another, are then provided. In order to produce rotations, electrically, pneumatically or hydraulically operable rotary motors could be provided. It would further be conceivable also to make a rotation possible by means of linear actuators, which then engage eccentrically to a rotary bearing of the respective carrier 8 or individual carrier 8.1, 8.2, 8.3 on the associated carrier 8 or individual carrier 8.1, 8.2, 8.3. It is possible to combine different actuators with one another in any desired manner, for example at least one of the carriers 8 and/or individual carriers 8.1, 8.2, 8.3 could be movable by means of a robotic arm having a plurality of actuators.

The at least one actuator is connected to a control device for the activation, preferably the automatic activation, of the actuator.

Each of the entangling units 7.1, 7.2, 7.3 has an associated separately controllable compressed air supply 7.1.*z*, 7.2.*z*, 7.3.*z*.

To that end, the compressed air supplies 7.1.*z*, 7.2.*z*, 7.3.*z* are each connected according to FIGS. 2 and 3 by means of a respective pressure setting means (or device) 9.1, 9.2, 9.3 to a pressure source (not shown here). The flow channels necessary for this purpose are preferably implemented by means of movable hose lines, wherein such movable hose lines allow the entangling units 7.1, 7.2, 7.3 to move or move correspondingly with the entangling units 7.1, 7.2, 7.3. The compressed air supplies 7.1.*z*, 7.2.*z*, 7.3.*z*, in particular the pressure setting means 9.1, 9.2, 9.3 thereof, are connected for the open-loop and/or closed-loop control thereof to the control device.

In the following text, the components arranged according to FIG. 1 upstream and downstream of the entangling device 7 will now be described again in detail, wherein these components can preferably also be used correspondingly upstream and downstream of the entangling device 7 in the second and third embodiments according to FIGS. 2 and 3. The spinning device 2 is connected to multiple melt generators (not shown here), for example extruders, for providing a polymer melt. The spinning device 2 has a heated spinning beam 10, which carries multiple spinning nozzles 11.1 to 11.3 side by side. The spinning nozzles 11.1 to 11.3 each have on their underside a plurality of nozzle apertures, through each of which a filament bundle of the polymer melt is extruded during operation. Beneath the spinning device 2 there is provided the cooling device 3, by means of which the extruded filaments are cooled. After the filaments have been cooled, they are in each case brought together by the thread guides 12 to form an individual thread 5.1 to 5.3. For pulling out the individual threads 5.1 to 5.3 from the spinning nozzles 11.1 to 11.3 there is provided the drawing device 4, which has a plurality of driven godet wheels. The individual threads 5.1 to 5.3 are individually entangled beforehand by a pre-entangling device 13 by a plurality of pre-entangling nozzles 13.1 to 13.3. On the periphery of the godet wheels of the drawing device 4, the individual threads 5.1 to 5.3 are guided parallel to one another with multiple loops. The drawing device 4 here has two so-called godet wheel duos. After the individual threads 5.1, 5.2 and 5.3 have been pulled out and drawn by the drawing device 4, the individual threads 5.1, 5.2 and 5.3 are separated and entangled by means of the entangling device 7 immediately before being crimped by the crimping device 6. After the crimped composite thread 1 has been cooled, it is removed from the periphery of the cooling drum 6.3 by a take-off godet wheel unit 14, wherein the thread plug is opened. After post-treatment in a post-entangling device 15, the composite thread 1 is wound on a bobbin 17. The composite thread 1 wound on the bobbin 17 can be used directly for producing carpets. For the production of carpets, such composite threads 1 have a predetermined visual appearance, which is defined by the colours of the individual threads 5.1, 5.2 and 5.3.

These visual appearances of the composite thread are achieved substantially by the entanglement of the individual threads 5.1, 5.2 and 5.3 immediately prior to crimping. The different colours of the individual threads 5.1, 5.2 and 5.3 can be produced, for example, by supplying granules of different colours to the extruders. It is further conceivable to introduce different liquid dyes into the polymer melts between the melt generators, for example the extruders, and the spinning nozzles 11.1, 11.2 and 11.3.

The method described hereinbelow for producing the crimped composite thread 1 can be carried out in particular by means of the apparatus described hereinbefore for producing the crimped composite thread 1.

In the method for producing the crimped composite thread 1, multiple individual threads 5.1, 5.2, 5.2 are each extruded as a plurality of strand-shaped filaments, cooled, drawn by means of the drawing device 4 and together crimped by means of the crimping device 6 to form the composite thread 1. Before the multifilament individual threads 5.1, 5.2, 5.3 are crimpled, they are each entangled separately by means of in each case an entangling unit 7.1, 7.2, 7.3 of an entangling device 7.

A position and/or orientation of at least one of the entangling units 7.1, 7.2, 7.3 relative to the drawing device 4, the crimping device 6 and/or a further one of the entangling units 7.1, 7.2, 7.3 is changed during the production of the crimped composite thread 1.

The colouring of the composite thread 1 is thus also changed continuously. Desired colour patterns are produced in the composite thread 1, which results in corresponding colour patterns in carpets produced from such composite threads 1.

The position and/or orientation of the entangling device 7, namely of all the entangling units 7.1, 7.2, 7.3 together, relative to the drawing device 4 and/or relative to the crimping device 6 is changed during the production of the crimped composite thread 1.

For example, the common carrier 8 is continuously moved to and from in the Z direction between two end positions, so that the distance from the crimping device 6 and the associated feed and discharge angles change continuously. A continuous circular or elliptical movement in a plane would also be conceivable. In the case of such a movement, the common carrier 8 could be moved at a constant speed. In principle, however, all movement sequences which result in a desired colouration of the composite thread 1 and not in undesirable damage to the composite thread are conceivable.

The position and/or orientation of at least one of the entangling units 7.1, 7.2, 7.3 is, for example, changed automatically by means of a control device on the basis of measured properties of the composite thread 1, in particular the colour thereof, in order to achieve desired properties of the composite thread 1, in particular the colour thereof.

The aim in the case of such closed-loop control of the colour of the composite thread 1 can be a particular unvarying colour or a particular change in the colour of the composite thread 1.

The position and/or orientation of at least one of the entangling units 7.1, 7.2, 7.3 is changed by means of the control device, for example, on the basis of a predefined movement pattern present in the control device.

Movement patterns which have already been tried and tested and the resulting colouration of the composite thread 1 can thus easily be retrieved. Examples of conceivable movement patterns are the changing movement along a line, circular or elliptical movements which have already been mentioned. However, three-dimensional movement patterns are also possible. On the other hand, the movement pattern could also meet particular specifications, such as, for example, a particular, constant discharge angle of one of the individual threads 5.1, 5.2, 5.3 from the entangling device 7.

The individual threads 5.1, 5.2, 5.3 are, for example, each entangled with different compressed air set-point values of a compressed air supply 7.1.*z*, 7.2.*z*, 7.3.*z*.

The compressed air set-point values can also be changed during the production of the crimped composite thread 1 if this results in a desired colouration of the composite thread.

LIST OF REFERENCE SIGNS

1 composite thread
2 spinning device
3 cooling device
4 drawing device
5.1 first individual thread
5.2 second individual thread
5.3 third individual thread
6 crimping device
6.1 conveying nozzle
6.2 stuffer box
6.3 cooling drum
7 entangling device
7.1 first entangling unit
7.1.*d* entangling nozzle of the first entangling unit
7.1.*z* compressed air supply of the first entangling unit
7.2 second entangling unit
7.2.*d* entangling nozzle of the second entangling unit
7.2.*z* compressed air supply of the second entangling unit
7.3 third entangling unit
7.3.*d* entangling nozzle of the third entangling unit
7.3.*z* compressed air supply of the third entangling unit
8 carrier
8.1 first individual carrier
8.2 second individual carrier
8.3 third individual carrier
9.1 first pressure setting means
9.2 second pressure setting means
9.3 third pressure setting means
10 spinning beam
11.1 first spinning nozzle
11.2 second spinning nozzle
11.3 third spinning nozzle
12 thread guide
13 pre-entangling device
13.1 first pre-entangling nozzle
13.2 second pre-entangling nozzle
13.3 third pre-entangling nozzle
14 take-off godet wheel unit
15 post-entangling device
16 winding apparatus
17 bobbin

The invention claimed is:

1. Apparatus for producing a crimped composite thread, having a spinning device, a cooling device and a drawing device for producing multiple multifilament individual threads, having a crimping device for bringing the individual threads together to form the composite thread and having an entangling device, arranged upstream of the crimping device, for entangling the individual threads separately in each case by means of entangling units, wherein a position and/or orientation of at least one of the entangling units relative to the drawing device, the crimping device and/or a further one of the entangling units is changeable by means of at least one actuator.

2. Apparatus according to claim 1, wherein each entangling unit has an entangling nozzle, which entangling nozzles are arranged on a common carrier of the entangling device, and the position and/or orientation of the carrier is changeable by means of the at least one actuator.

3. Apparatus according to claim 2, wherein each entangling unit has an individual carrier for holding the associated entangling nozzle, wherein the position and/or orientation of each individual carrier is changeable in each case by means of at least one actuator.

4. Apparatus according to claim 3, wherein an adjustment range of at least one of the actuators is from 5 mm to 60 mm.

5. Apparatus according to claim 3, wherein the at least one actuator is configured to permit a movement of the carrier and/or individual carrier coupled with said actuator in at least one of six degrees of freedom.

6. Apparatus according to claim 3, wherein the at least one actuator is connected to a control device for the activation of said actuator.

7. Apparatus according to claim 1, wherein a separately controllable compressed air supply is associated with each of the entangling units.

8. Method for producing a crimped composite thread, in which multiple individual threads are extruded in each case in the form of a plurality of strand-shaped filaments, cooled, drawn by means of a drawing device and together crimped by means of a crimping device to form the composite thread, wherein, before the multifilament individual threads are crimped, they are entangled separately in each case by means of entangling units of an entangling device, wherein a position and/or orientation of at least one of the entangling units relative to the drawing device, the crimping device and/or a further one of the entangling units is changed during the production of the crimped composite thread.

9. Method according to claim 8, wherein the position and/or orientation of the entangling device, having all the entangling units together, relative to the drawing device and/or relative to the crimping device is changed during the production of the crimped composite thread.

10. Method according to claim 8, wherein the position and/or orientation of at least one of the entangling units is changed automatically by means of a control device on the basis of measured properties of the composite thread, which includes colour thereof, in order to achieve desired properties of the composite thread, which includes colour thereof.

11. Method according to claim 8, wherein the position and/or orientation of at least one of the entangling units is changed by means of the control device on the basis of a predefined movement pattern present in the control device.

12. Method according to one claim 8, wherein the individual threads are entangled with in each case different compressed air set-point values of a compressed air supply.

* * * * *